US005267686A

United States Patent [19]

Gulliver et al.

[11] Patent Number: 5,267,686

[45] Date of Patent: Dec. 7, 1993

[54] FOOD PACKAGE CONTAINING SEPARATE TRAYS CONNECTED TOGETHER BY A SINGLE LID STRUCTURE

[75] Inventors: Richard E. Gulliver; James R. Green, both of Tuscaloosa, Ala.

[73] Assignee: Gulf States Paper Corporation, Tuscaloosa, Ala.

[21] Appl. No.: 964,870

[22] Filed: Oct. 22, 1992

Related U.S. Application Data

[63] Continuation-in-part of Ser. No. 796,599, Nov. 22, 1991, Pat. No. 5,183,201.

[51] Int. Cl.[5] ..... B65D 5/48; B65D 5/58

[52] U.S. Cl. ..... 229/120.011; 229/120.16; 229/186; 229/228; 229/242; 229/906

[58] Field of Search ..... 229/120.16, 120.17, 229/120.011, 125.35, 186, 228, 240, 242-244, 902, 903, 906

[56] References Cited

U.S. PATENT DOCUMENTS

| | | | |
|---|---|---|---|
| D. 302,068 | 7/1989 | Forbes, Jr. et al. . | |
| 2,781,159 | 2/1957 | Copeman | 229/186 |
| 3,146,934 | 9/1964 | Steiger | 229/186 |
| 3,211,359 | 10/1965 | Fickes | 229/240 |
| 3,253,765 | 5/1966 | Train | 229/120.011 |
| 3,829,004 | 8/1974 | Graser . | |
| 3,863,832 | 2/1975 | Gordon et al. . | |
| 4,130,237 | 12/1978 | Struble | 229/40 |
| 4,215,780 | 8/1980 | Carlson | 206/424 |
| 4,304,352 | 12/1981 | Humphries | 229/186 |
| 4,361,236 | 11/1981 | Lavery . | |
| 4,594,492 | 6/1986 | Maroszek | 206/591 |
| 4,742,917 | 5/1988 | Bornwasser et al. | 229/120.011 |
| 4,746,019 | 5/1988 | Prater | 229/232 |
| 4,836,439 | 6/1989 | Hart | 229/104 |
| 4,901,911 | 2/1990 | Drexhage | 229/114 |
| 4,919,269 | 4/1990 | Wright et al. | 229/120.011 |
| 4,919,785 | 4/1990 | Willey et al. | 229/188 |
| 4,930,639 | 6/1990 | Rigby | 229/186 |
| 4,944,451 | 7/1990 | Forbes, Jr. . | |
| 4,951,868 | 8/1990 | Mode | 229/125.35 |
| 5,009,320 | 4/1991 | Kramer | 229/232 |
| 5,012,929 | 5/1991 | Roosa | 229/120.011 |
| 5,038,940 | 8/1991 | Okabe | 229/120.011 |
| 5,183,201 | 2/1993 | Gulliver | 229/117.12 |

*Primary Examiner*—Gary E. Elkins
*Attorney, Agent, or Firm*—Cushman, Darby & Cushman

[57] ABSTRACT

A food package comprising a plurality of separate portions of food and a carton assembly. The carton assembly comprises a plurality of separate open top trays corresponding in number to the number of separate portions of food and a lid structure. The separate relation of the open top trays enabling each of the separate portions of food to be separately disposed within a corresponding separate open top tray. The open top trays are erected from blanks and each includes a bottom surrounded by sides with liquid tight corner constructions and at least one outwardly extending flange. The lid structure includes a top wall panel and two top flaps. The trays, in side by side relation, are covered by the lid structure in an assembled relation and secured therein by adhesive so as to form a food package suitable for convenient transportation and handling. In assembled relation the tray flanges are disposed in side by side relation and adhesively adhered to the top wall panel between the top flaps which are folded down to form exterior sides of the package. The lid structure has cuts formed therein for facilitating the manual movement of at least a portion of the lid structure extending in enclosing relation over the open top of each tray into an open condition with respect to each tray enabling the portion of food in each tray to be heated in an oven and thereafter consumed while in the respective tray.

31 Claims, 6 Drawing Sheets

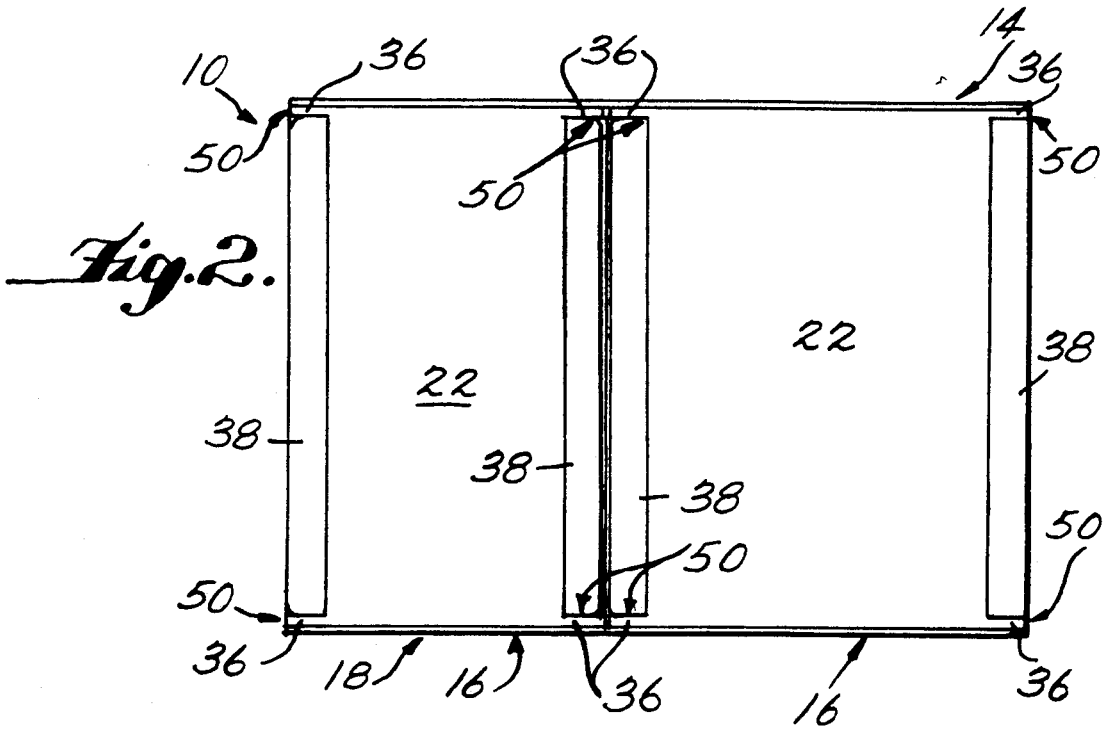
Fig. 2.
Fig. 1.
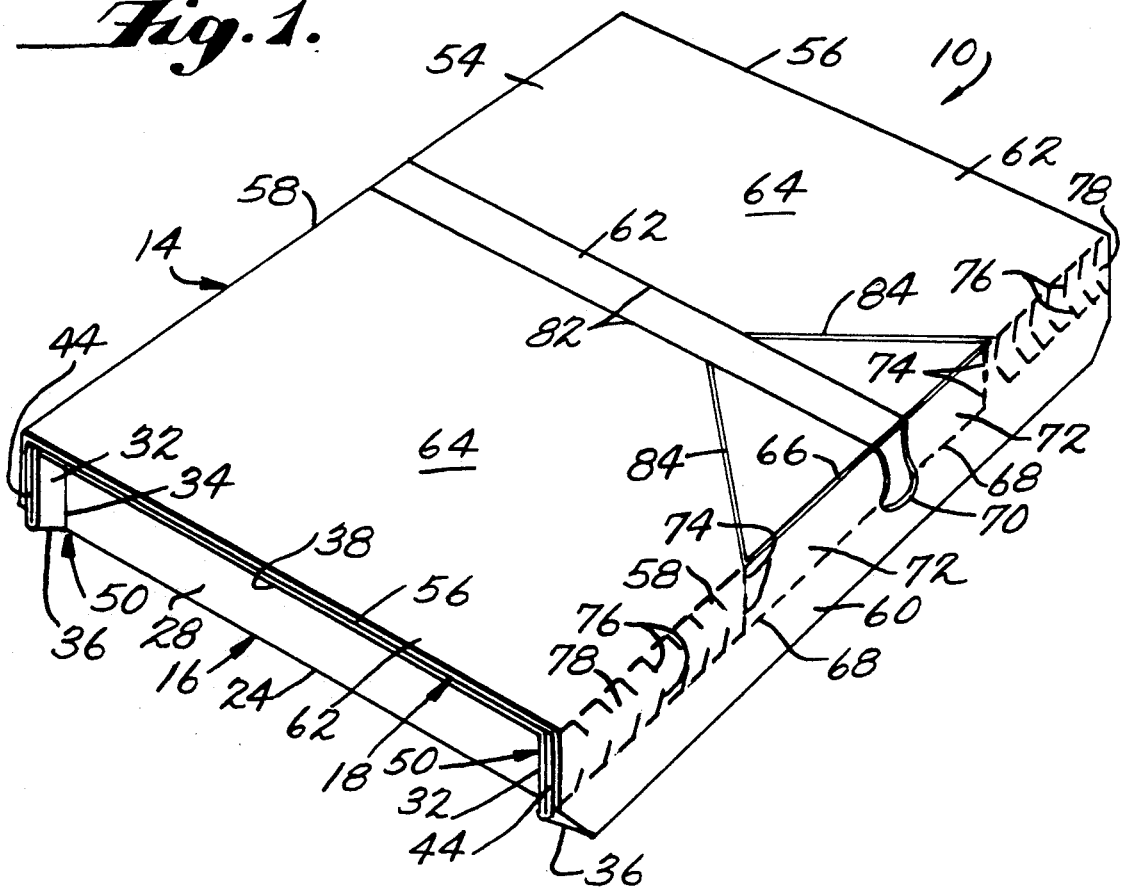

FOOD PACKAGE CONTAINING SEPARATE TRAYS CONNECTED TOGETHER BY A SINGLE LID STRUCTURE

This application constitutes a continuation-in-part of application Ser. No. 07/796,599, filed Nov. 22, 1991, now U.S. Pat. No. 5,183,201, in the name of Richard F. Gulliver for CARBON TRAY WITH IMPROVED CORNER CONSTRUCTION AND METHOD OF MAKING.

This invention relates to food packages and more particularly to food packages of the type including a carton assembly containing separated plural food portions.

The '599 application identified above discloses a food package which includes a carton assembly containing a single food portion. The carton assembly consists essentially of an open top tray structure within which the food portion is contained and a lid structure secured to the tray structure in enclosing relation to the open top thereof. The tray structure is suitable to retain consumable food contents therein containing liquid so that the contents can be (1) heated in an oven while retained therein and (2) thereafter consumed while retained therein.

The tray is erected from a flat carton blank which includes (1) a bottom wall panel having a periphery defined along four sides by four side fold lines interrelated so that there are four different pairs of adjacent side fold lines wherein each pair of adjacent side fold lines extends at an angle with respect to each other from a corner point defining one of four corners of the bottom wall panel, (2) four side wall panels integral with the bottom wall panel along the four side fold lines interrelated so that there are four pairs of adjacent side wall panels, and (3) a gusset wall panel integral with each pair of adjacent side wall panels along two end fold lines extending in angularly related relation with respect to one another from the corner point associated with the pair of adjacent side fold lines with which the pair of adjacent side wall panels is integral. The side wall panels are folded along the side fold lines in a direction which is the same in relation to the bottom wall panel into an erected position wherein each of the gusset wall panels is folded along the associated angularly related end fold lines in opposite directions with respect to the associated pair of adjacent side wall panels so as to bring each gusset wall panel into surface-to-surface abutting relation with an end portion of one of the associated pair of adjacent side wall panels defined by one of the associated two end fold lines. An adhesive serves to adhere each of the gusset wall panels in abutting relation with the associated one side wall end portion to thereby form a sealed integral corner construction between each pair of adjacent side wall panels which is defined (1) exteriorly by the associated gusset wall panel adhesively adhered in abutting relation to the associated one side wall end portion with the associated one end fold line extending generally in plane coincident with an interior surface of the associated one side wall panel from the associated corner point and (2) interiorly by another of the associated two end fold lines extending from the associated corner point along the surface of the associated one side wall panel.

The corner construction of the '599 application has the advantage that it can be machine set up in a much quicker time than a corner construction utilizing two gusset wall panels which are initially adhered together and then folded and secured in abutting relation to an exterior surface of an adjacent side wall. This quicker set up time is highly advantages and cost effective because the set up time for the cartons is a limiting factor in packaging lines utilizing trays of this type. It is presently estimated that an operation which heretofore was of a capacity requiring four lines could be handled in the same time with three lines a significant cost reduction for the packager.

While the present invention is particularly concerned with the provision of a food package having a plurality of tray structures of the type disclosed in the '599 application, in its broadest aspects, the present invention contemplates a food package in which the tray structures have other corner constructions, such as the folded double gusset corners known in the art. Indeed, plural compartment food packages embodying this type of tray structure have also been proposed in the patent literature. Such food packages are exemplified in U.S. Pat. No. 4,944,451, in FIGS. 4 and 5 of U.S. Pat. No. 3,863,832, and in Design Patent D No. 302,068.

The plural compartment package disclosed in each of the above two utility patents includes a carton assembly consisting essentially of a single plural compartment tray structure and a separate lid structure for closing both compartments of the tray structure. There are several problems presented in constructing a package in the manner taught in these two patents. First, the plural compartment tray structure which is made from one blank presents difficulties in the machinery utilized to erect the tray structures from the blanks. Specifically, the machinery must provide an interior support for setting up the division walls between the two compartments. The necessity for this support prevents a simple plunger and die set-up and necessitates a removable center support. This type of arrangement inherently limits the number of set-ups which can be completed per unit time. Moreover, the fixed interrelationship between the plural compartments makes it necessary to modify the filling line to ensure that each compartment can be properly filled with its respective portion of food.

The above design patent appears to disclose the alternative of providing separate trays with double gusset folded corners and full peripheral flanges with a lid in a single package wherein the lid is a separate flat cover mounted over the trays and secured to the peripheral flanges thereof. The lid of the integral plural tray configuration of the utility patents is likewise a separate flat cover suitably adhered to the peripheral flanges of the integral plural tray structure.

While the separate plural tray package of the design patent alleviates the problem of the integral plural tray package, the resultant separate plural tray package of the design patent has another disadvantage; namely, the package lacks structural integrity. The lack of structural integrity exists along the juncture between the plural compartments where the only structure provided is essentially in one plane, thus forming essentially a hinge which allows the portions of the package on opposite sides of the hinge to bend and flex with respect to one another along the hinge. This flexure tendency is increased by the weight of the food contents and, when the contents are heated, the flexure tendency makes the package more accident-prone.

It is an object of the present invention to provide a plural compartment food package which alleviates all of the disadvantages noted above. In accordance with the principles of the present invention, this objective is accomplished by providing a food package comprising a plurality of separate portions of food and a carton assembly. The carton assembly comprises a plurality of separate open top trays corresponding in number to the number of separate portions of food and a lid structure. Each of the open top trays is formed from a blank of carton material cut and scored to form a bottom wall panel having a periphery defined by interconnecting side fold lines having side wall panels extending therefrom which are interconnected by gusset wall portions. The side wall panels have outer edges at least one of which is defined by a flange fold line having a flange extending therefrom. Each of the tray-forming blanks is folded and secured in an open top tray-forming condition wherein (1) the side wall panels are folded along the side fold lines to form tray sides around a tray bottom formed by the bottom wall panel, (2) the gusset wall portions are folded and sealed to provide liquid tight corners for the tray sides, and (3) the flange is folded along the flange fold line to form an outwardly extending flange along the one outer edge of the side wall panels. The lid structure is formed from a flat blank of carton material cut and scored to form a top wall panel having a periphery defined along two sides by top fold lines and two top flaps integral along the top flap fold lines with the top wall panel. The separate relation of the open top trays enabling each of the separate portions of food to be separately disposed within a corresponding separate open top tray. The separate relation of the lid structure enabling the lid structure and trays after the portions of food have been disposed in the trays to be moved relatively together into an assembled relation forming the carton assembly wherein (1) the top wall panel extends over the trays with the flanges of the trays extending in side-by-side relation in surface-to-surface engagement with a central portion of the top wall panel between the top flaps, and (2) the top flaps are folded downwardly from the top wall panel along the top fold lines thereof so as to form exterior sides of the carton assembly. The lid structure and trays are fixedly secured by adhesive into their assembled relation including an adhesive between the flanges and the top wall panel adhering the same in surface-to-surface engagement. The carton assembly has cuts formed therein for facilitating the manual movement of at least a section of the top wall panel extending over the open top of each tray into an open position with respect to the open top of each tray enabling the portion of food in each tray to be heated in an oven and thereafter consumed while in the respective tray.

Another object of the present invention is to provide a plurality of carton blanks erectable to form a carton assembly for a plurality of separate food portions. The plurality of carton blanks comprise a plurality of separate tray forming blanks of carton material each being cut and scored to form a bottom wall panel having a periphery defined by interconnecting side fold lines having side wall panels extending therefrom which are interconnected by gusset wall portions, the side wall panels having outer edges at least one of which is defined by a flange fold line having a flange extending therefrom. The tray forming blanks are foldable and sealable into a plurality of separate open top trays wherein (1) the side wall panels of each blank are folded along the side fold lines thereof to form tray sides around a tray bottom formed by the bottom wall panel thereof, (2) the gusset wall portions of each blank are folded and sealed to provide liquid tight corners for the tray sides of each tray, and (3) the flange of each blank is folded along the flange fold line to form an outwardly extending flange along the one outer edge of the side wall panels. The plurality of carton blanks also includes a lid blank of carton material cut and scored to provide a top wall panel having a periphery defined on two sides by two top flap fold lines and two top flaps integral with the top wall panel along the top flap fold lines. The top wall panel has a pair of side-by-side flange-engaging portions extending between the top flaps thereof defining top panel portions on opposite sides of the pair of flange-engaging portions. The pair of flange-engaging portions and top panel portions are sized so that when the pair of flange-engaging portions are disposed in engagement with the side-by-side flanges of side-by-side trays the top panel portions enclose the open tops of the erected trays. The two top flaps are foldable downwardly from the top wall panel along the top flap fold lines and are adapted to be secured to the trays at positions below the flanges thereof to complete the enclosure of the erected trays and form exterior sides of a unitary package suitable for transport and handling. The lid blank also includes cuts formed there for facilitating the manual lifting of at least a section of each top panel portion into opening relation to each erected tray.

As previously indicated, with both the food package subject matter and the three blanks subject matter, a folded double gusset corner construction is contemplated but the single gusset adhesively adhered to the side wall end portion corner construction of the '599 application is greatly preferred.

Another object of the present invention is the provision of a food package of the type described which is simple in construction, economical to assemble and efficient in operation.

These and other objects of the present invention will become more apparent during the course of the following detailed description and appended claims.

The invention may best be understood with reference to the accompanying drawings wherein an illustrative embodiment is shown.

IN THE DRAWINGS

FIG. 1 is a perspective view of a food package embodying the principles of the present invention;

FIG. 2 is a bottom plan view of the package shown in FIG. 1;

Referring now more particularly to FIGS. 1 and 2 of the drawings, there is shown therein a plural compartment food package, generally indicated at 10, which embodies the principles of the present invention. The food package 10 consists essentially of a plurality of food portions 12 (see FIG. 8) contained within a carton container assembly, generally indicated at 14, which is made up of a plurality of open top carton tray structures, generally indicated at 16, and a lid structure, generally indicated at 18.

Figure 3:
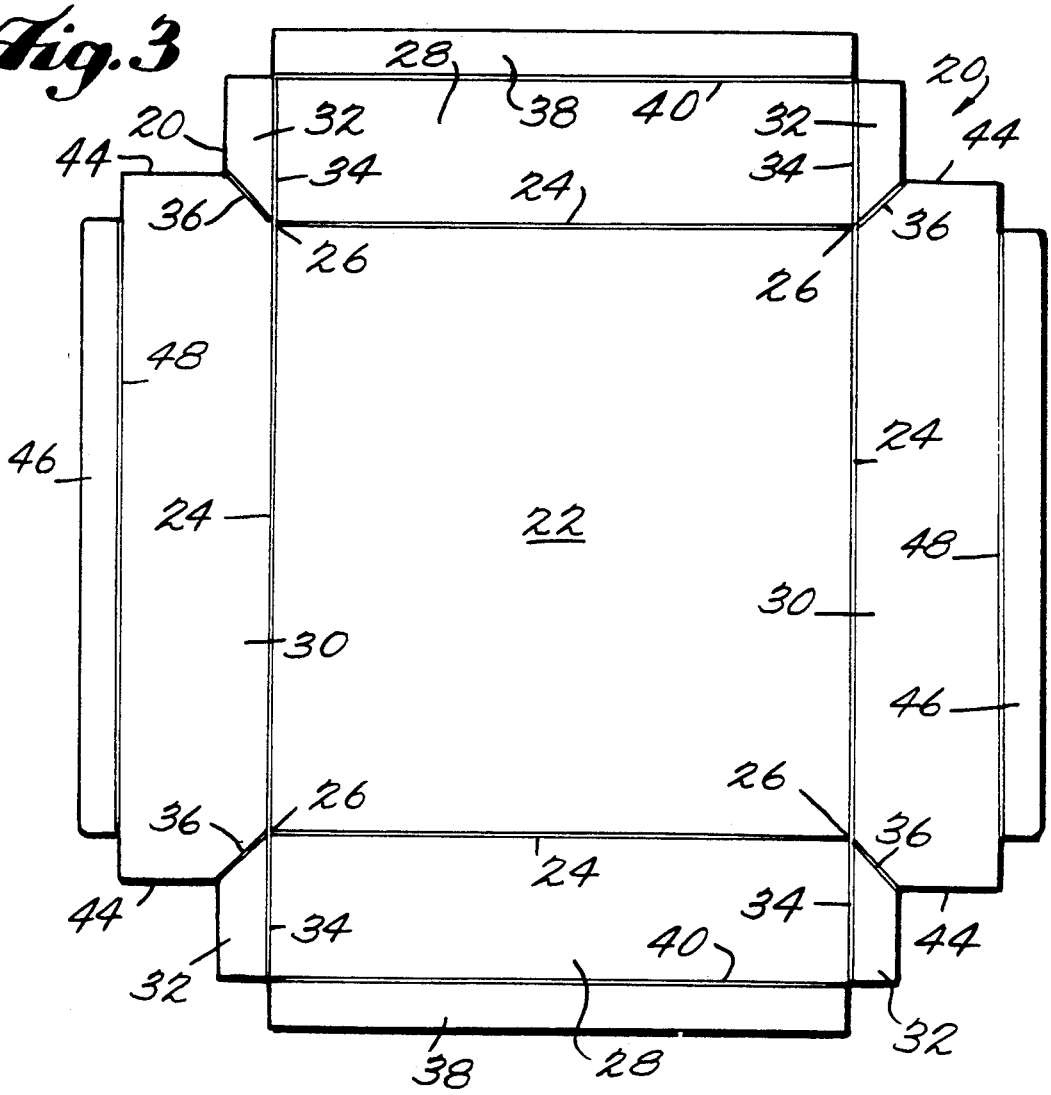
FIG. 3 is a top plan view of a tray blank which can be erected to form a tray structure of the package shown in FIG. 1.
Figure 4:
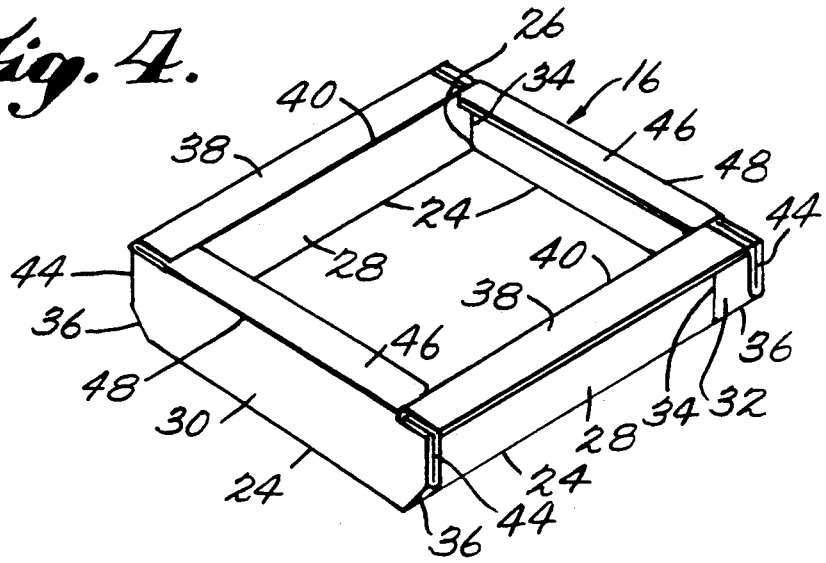
FIG. 4 is a perspective view of the tray erected from the blank shown in FIG. 3.
Figure 5:
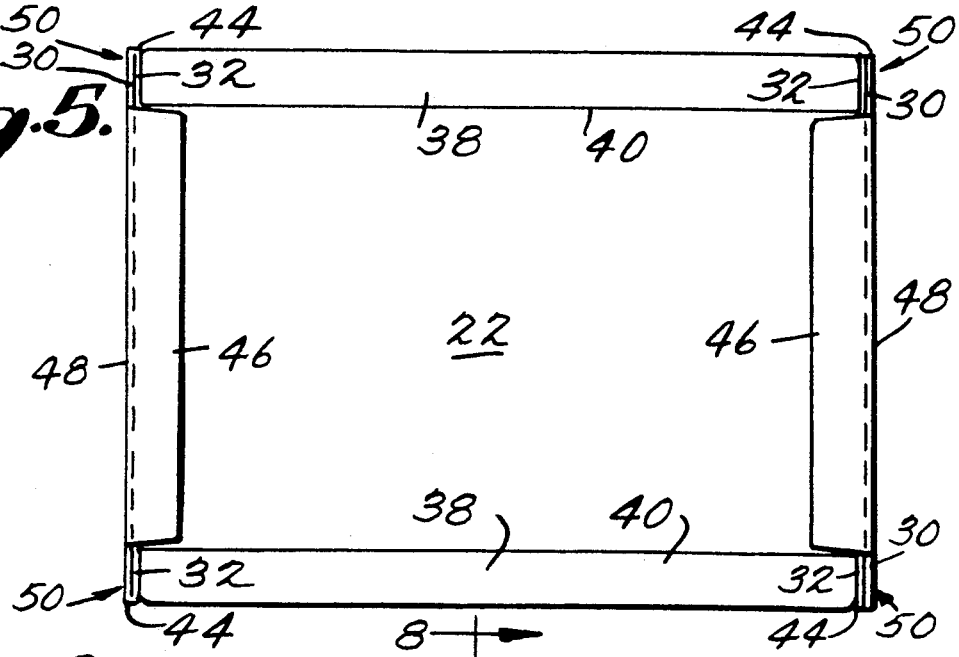
FIG. 5 is a top plan view of the tray.
Figure 6:
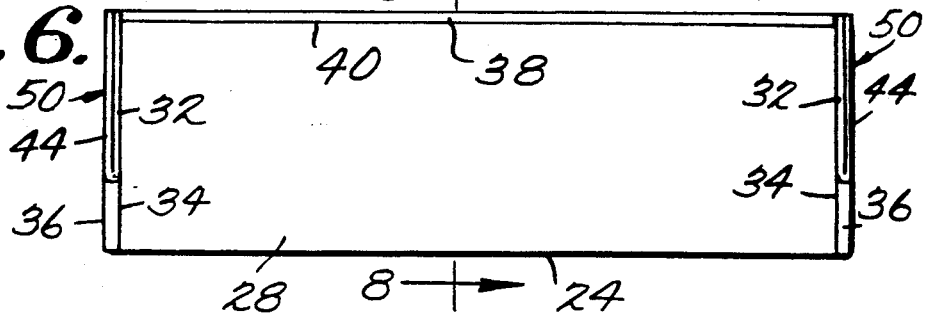
FIG. 6 is a side view of the tray.
Figure 7:
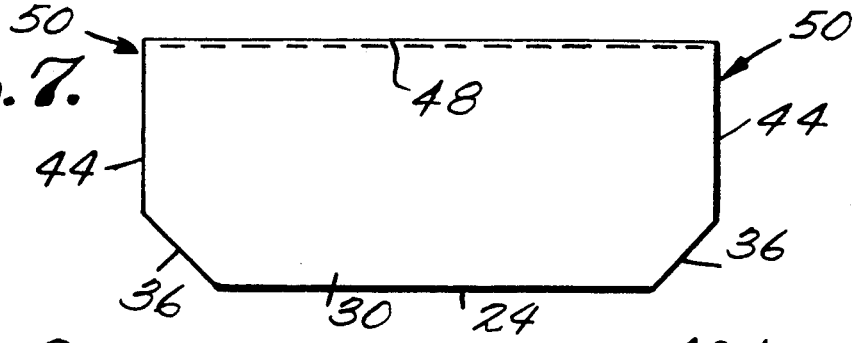
FIG. 7 is an end view of the tray.

Referring now more particularly to FIG. 3 of the drawings, there is shown therein a carton tray blank, generally indicated at 20, which is erectable to form a carton tray structure 16. Preferably, the carton blank 20 is constructed in accordance with the disclosure of the aforesaid application, which is hereby incorporated by reference into the present invention.

The blank 20 is formed of any suitable carton material as, for example, paperboard. It will be understood that the carton material may be in the form of a laminate, such as a plastic film (e.g., polypropylene or PET) laminated to paperboard. Preferably, the plastic film is on the interior of the paperboard blank although it may be provided on the exterior as well. The laminate may include in selective portions throughout the paperboard material a microwave susceptor material. The susceptor material may either be microwave-interactive or microwave-shielded material.

As shown, the blank material is suitably cut and/or scored to provide a bottom wall panel 22 defined peripherally by four side fold lines 24 defining four corners 26. The carton tray blank 20 also includes first and second pairs of opposite side wall panels 28 and 30 which are integral with the bottom wall panel 22 along the side fold lines 24. The fold lines 24 may be of any desired construction, an exemplary embodiment being regular bar scores as viewed from the side of the blank forming the interior of the carton tray when erected. The side shown in FIG. 3 is also the side of the paperboard blank 20 on which the plastic film is adhered when the blank is made of a laminate.

The carton tray blank 20 also includes four gusset wall panels 32, each of which is integral with two adjacent side wall panels 28 and 30 along two end fold lines 34 and 36 extending from an associated corner 26 in angularly related relation with respect to one another. As shown, the end fold line 34 of each gusset wall panel 32 is integral with an end of one of the first pair of opposed side wall panels 28 and extends from the associated corner 26 with respect to the associated side fold line 24 at an angle of approximately 90°. The end fold lines 34 may exemplarily be formed as reverse bar scores which are offset with respect to the corner 26 a distance equal to the paperboard thickness. The other end fold line 36 of each gusset wall panel 32 is integral with an end of one of the second pair of opposite side wall panels 30 and extends from the associated corner 26 at an angle of approximately 135° with respect to the associated side fold line 24. The end fold lines 36 may exemplarily be regular bar scores the ends of which are spaced slightly from the ends of the fold lines once folded.

The first pair of side wall panels 28 includes flanges or edge wall panels 38 formed integrally therewith throughout the width thereof along edge fold lines 40. Each of the second pair of opposite side wall panels 30 includes an outer end portion 42 at each end thereof which is defined by the associated fold line 36 and a pair of angularly related peripheral edges 44. Formed integrally on each of the second pair of opposite side wall panels 30 in the central portion thereof between the outermost edges 44 is an edge wall panel 46 which is integral with the associated side wall panel 30 along an edge fold line 48.

The blank 20 is erectable in accordance with the principles enunciated in the aforesaid '599 application, into a carton tray structure 16. The method of erection is preferably carried out utilizing a plunger and die type apparatus in which the blank 20 is mounted over the die with the bottom wall panel 22 facing in a direction to receive the plunger which is configured to engage substantially the entire bottom wall panel. As the plunger moves downwardly through the die, the side wall panels 28 and 30 progressively engage the sides of the die and are simultaneously progressively folded about the side fold lines 24 in the same direction. Concurrently with the folding movement of the side wall panels 28 and 30, the gusset wall panels 32 are progressively folded along the angularly related end fold lines 34 and 36 in opposite directions with respect to the associated pair of adjacent side wall panels 28 and 30 so as to bring the gusset wall panels 32 into surface-to-surface abutting relation with the end portions 42 of the side wall panels 30 defined by the end fold lines 36 and edges 44. The gusset wall panels 32 are then adhesively adhered in surface-to-surface abutting relation with the end portions 42 to thereby form a sealed integral corner construction, generally indicated at 50, between each pair of adjacent side wall panels 28 and 30 extending outwardly from the side wall panels 28.

When a plunger and die apparatus is utilized to carry out the method of erecting of the present invention, preferably the adhesive adhering procedure is performed at the end of the operative stroke of the plunger during which each corner construction 50 is moved past a pair of cooperating pressure rolls to apply an adhering pressure between the interengaged gusset wall panels and end portions.

The adhesive utilized may be of any type including either heat activated or pressure activated adhesives. The adhesive may be separately applied to the appropriate portions of the carton tray blank 20 prior to erection or during erection. Any suitable adhesive may be utilized, it being understood that where the carton material comprises a laminate including a plastic film on the interior surface of the paperboard, portions of the plastic film itself may constitute the adhesive which is activated by heat preferably by directing a stream of hot air locally thereto just prior to the erecting procedure or the operative stroke of the plunger. The latter constitutes a preferred adhesive embodiment.

It can be seen that each sealed integral corner construction 50 of the carton tray 16 thus erected is defined (1) exteriorly by the associated gusset wall panel 32 adhesively adhered in abutting relation to the associated side wall end portion 42 with the associated end fold line 36 extending generally in a plane coincident with an interior surface of the side wall panel 30 from the associated corner 26 and (2) interiorly by the associated end fold line 34 extending from the associated corner 26 along the interior surface of the associated side wall panel 30. It will be understood that the end fold lines need not extend exactly from the corner 26. Indeed, as previously stated, it is desirable that the end fold lines 34 be offset to an extent generally equal to the thickness of the blank material and the end fold lines 36 start in closely spaced relation from the corner 26.

The edge wall panels 38 and 44 may be folded along their respective edge fold lines 40 and 46 either outwardly or inwardly. The construction of the fold lines are chosen to be suitable to the direction of the fold. Preferably, the pair of flanges or edge wall panels 38 are folded outwardly, so that they are coextensive with the corner constructions 52 and the pair of edge wall panels 44 are folded inwardly.

In accordance with the principles of the present invention, a plurality of carton tray structures or parts 16 mounted in cooperating relation with a carton lid structure or part 18 form the carton assembly 14 of the package 10 containing a plurality of food portions 12 within the space above the bottom wall panel 22 defined by the side wall panels 28 and 30 of each tray structure.

Figure 9:
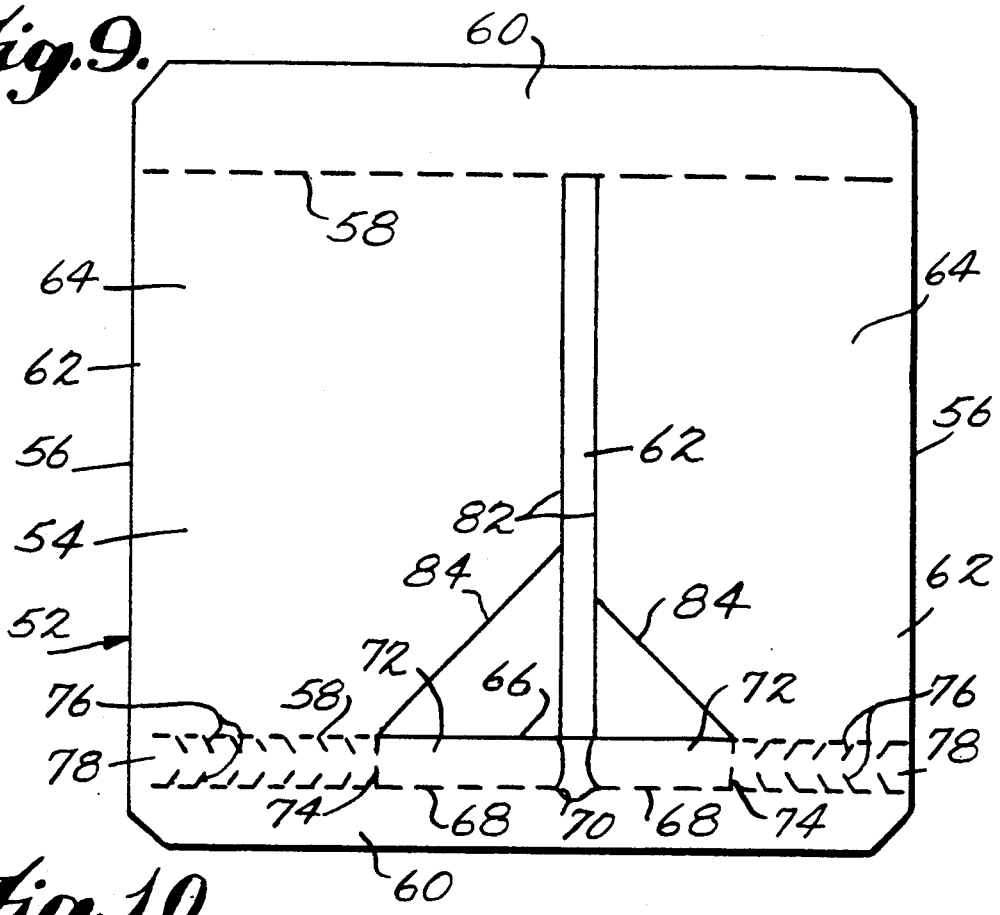
FIG. 9 is a top plan view of a lid blank which can be erected so as to form a lid structure of the package of FIG. 1.
Figure 10:
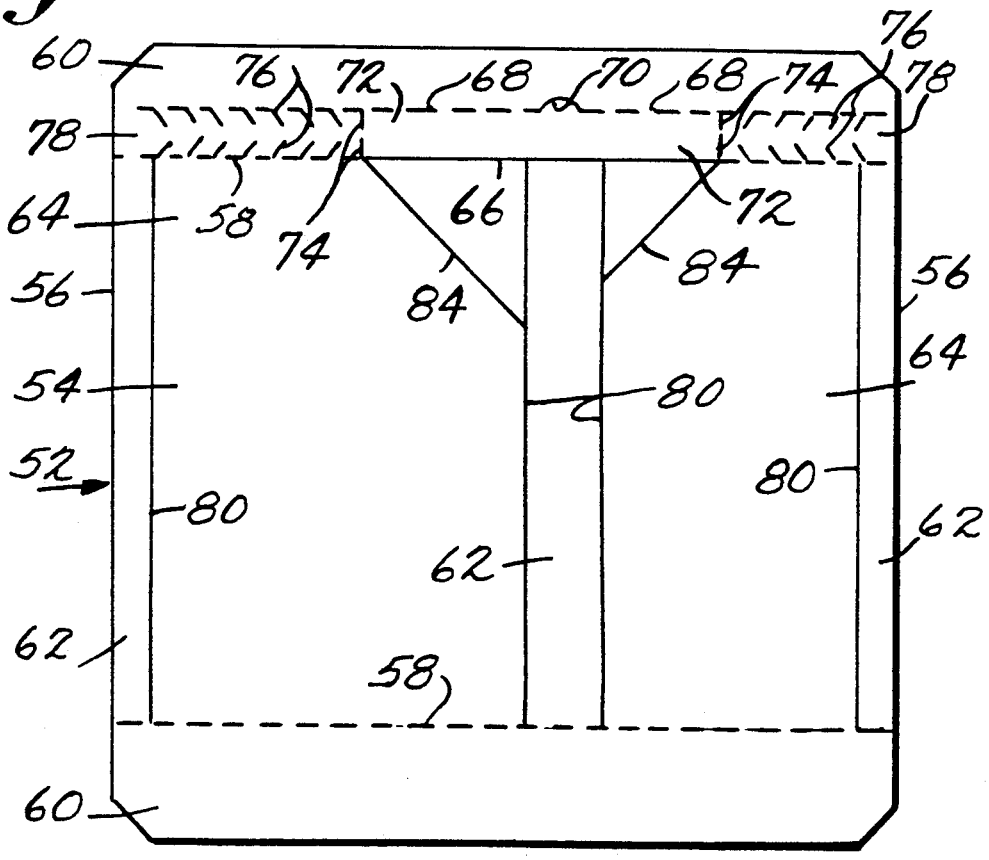
FIG. 10 is a bottom plan view of the lid blank shown in FIG. 9.

FIGS. 9 and 10 illustrate one embodiment of a carton lid blank, generally indicated at 52, which is erectable to form the lid structure 18 of the package 10. The carton lid blank 52 is formed of carton material like that of the tray blank 20. The carton material is cut and scored to define a top wall panel 54 having a rectangular periphery defined on a first pair of opposite sides by cut lid sides or edges 56 and on a second pair of opposite sides by lid fold lines 58 extending between the cut edges 56. Formed integral with the top wall panel 54 along the lid fold lines 58 is a pair of lid flaps 60.

The top wall panel 54 includes a planar interior surface shown in FIG. 10 (the plastic film surface when a laminate is used as the carton material) which is divided into four flange-engaging strip-like portions 62, arranged so as to define two top panel portions 64 therein. As shown, two of the four flange-engaging portions 62 are disposed singly along the two cut edges 56 respectively and two are paired together and extend across the central area of the top wall panel 54 between fold lines 58. The position of the paired central flange-engaging portions 62 is determined by the relative shapes of the two tray structures 16 utilized therewith. In the embodiment shown, the trays 16 are of different capacity and size so that the paired central flange-engaging portions 62 are off center. It will be understood that they would be on center where the two trays 16 are of the same size. It will also be understood that the package of the present invention contemplates more than two trays in which case additional paired central flange-engaging portions 62 would be provided.

Figure 8:
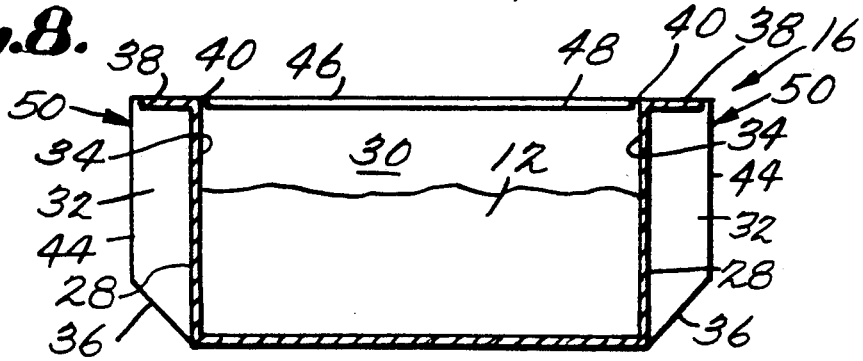
FIG. 8 is a sectional view taken along the lines 8—8 of FIG. 6.

When the package 10 is assembled, it will be understood that, after each tray blank 20 is erected into an open top tray structure 16, each tray is separately filled with a suitable food portion 12, such as shown in FIG. 8. Thereafter, a pair of filled trays 16 are oriented together in side-by-side relation with adjacent outwardly extending flanges 38 in generally closely spaced or abutting relation. Thereafter, the lid structure 18 is mounted over the paired trays 16 so that the downwardly facing interior surfaces of the flange-engaging portions 62 engage the upwardly facing surfaces of the flanges 38.

Where a plastic film laminate is used as the carton material, the interengaging surfaces of the flanges 38 and flange-engaging portions 62 will be plastic film surfaces which serve as adhesives when heated, as by a blast of hot air, to adhere the lid structure 18 to both of the tray structures 16. Thereafter, top flaps 60 are folded downwardly along lid fold lines 58 so as to bring the interior surfaces of the top flaps 60 into abutting relation with the exterior surfaces of the side walls 30 of the trays 16. Suitable adhesives are applied between the lower portions of these abutting surfaces to complete the assembly of the package 10.

As assembled, it will be noted that the top panel portions 64 serve to close the open top of the two trays 16 and enclose the food portions 12 separately in each tray 16. The adhesively adhered and interengaged relation between the flange-engaging portions 62 and lower portions of the top flaps 60 with the portions of the trays represented by the flanges 38 and lower portions of side walls 30 retain the assembly in a unitary package suitable for transportation and handling.

In accordance with the principles of the present invention, the lid structure 18 is provided with means in the form of cuts for facilitating the manual lifting of at least a portion of each top panel portion 64 into opening relation to each tray 16. Preferably, the cuts are made such that an initial relatively small vent opening can be made prior to inserting the package into an oven to heat the contents 12. In this regard, the contents 12 may initially be dry and require the addition of water before heating or the contents may contain liquid so that there is no need to add additional liquid before heating. After the contents have been heated with a smaller vent opening, the preferred arrangement of cuts provides for removing an additional portion of each top panel portion so as to provide substantially full access for eating the heated contents. It will be noted that the single outside flanges 38 of the trays 16 and the engaged flange-engaging portions 62 of the lid structure 18 provide convenient opposed handles for carrying the package 10 to and from the oven.

FIGS. 9 and 10 illustrate one embodiment of the preferred cuts provided to facilitate the manual opening of the package 10. In the embodiment shown, one of the top flaps 60 has its fold line 58 configured so that a central portion extending into each top panel portion 64 is a conventional bar score 66. Formed in the central portion of the one top flap 60 in parallel relation to the bar score 66 is a broken line of perforate cuts 68. A central section of the one top flap 60 aligned with the paired central flange-engaging portions 62 between the perforate cuts 68 and the bar score 66 is cut out as indicated at 70, so as to divide the section of the one top flap 60 between the perforated cuts 68 and the bar score 66 into two lifting tabs 72 defined at one end by the cut out 70 and at an opposite end by a transversely extending broken line of perforate cuts 74.

The remainder of the one top flap 60 outwardly of the lifting tabs 72 is provided with a series of perforate angular cuts 76 defining a pair of zip strips 78. It will be noted that aligned portions of the angular cuts define the remainder of the fold line 58 associated with the one top flap 60. The fold line 58 of the other top flap 60 may be of any suitable construction, such as a bar score or the broken line of perforate cuts as shown.

In order to facilitate the lifting of the top panel portions 64 into opening relation, there is formed in the interior surface of the top wall panel 54 a series of parallel 50% cut lines 80. The cut lines 80 are disposed in positions to define the inner edges of the single flange-engaging portions 62 and the outer edges of the paired flange-engaging portions 62. As shown, a pair of parallel 50% cut lines 82 are formed in the exterior surface of the top wall panel 54 so as to be disposed parallel to and inwardly of the two interior cut lines 80 associated with the paired central flange-engaging portions 62. Finally, a diagonal fold line 84 extends from each lifting tab end 74 to the associated exterior cut line 82. Fold lines 84 are preferably bar scores.

When it is desired to use the package 10, the user grabs first one end of one of the lifting tabs 72 and pulls upwardly, causing the perforate broken line cuts 62 and 74 to release the lifting tab 72 from the plane of the top flap 60. As the lifting tab is moved upwardly, the side defined by the fold line 66 of the corner triangle defined by the fold line 84 is separated from the top flap 60 so that, by pulling up on the lifting tab, the remaining leg of the triangular corner defined by the 50% cut lines 80 and 82 will effectively delaminate between the parallel cuts allowing the corner portion to be hinged upwardly along the fold line 84. This vents the associated contents in the associated tray structure 16 to the atmosphere. By similarly actuating the other lifting tab 72, the other tray structure is similarly vented.

In this condition, the user then carries the package to the oven with the flanges 38 and the engaged portions 62 of the top wall panel 54 serving as convenient handles. When the contents have been sufficiently heated, the user then returns the package to the table. It will be noted that, when each of the lifting tabs 72 have been moved upwardly in the manner previously described, the end of each zip strip 72 is conveniently presented to the user to be grasped and zipped off from the remainder of the top flap 60. When each zip strip 72 has been removed, the entire front edge of each top panel portion 64 defined by the fold line 58 is now released from the one top flap 60 enabling the user to simply continue lifting on each lifting tab 72 to separate substantially the entire portion of each top panel portion 64 from the top wall panel 54. Here again, it will be noted that the lifting action causes delamination to occur between the cut lines 80 and cut edges 56 as well as between the cut lines 80 and 82. Where the fold line 58 of the other top flap 60 is provided by a broken line of perforate cuts, each top panel portion can be removed from the remainder of the package. When the fold line 58 is a bar score, the top panel portions are simply folded back. It can thus be seen that substantially full access to the heated contents 12 of each of the trays 16 can be readily obtained by the user.

With this construction, the portion of the top wall panel 54 between the 50% cut lines 82 and the delaminated portions between the 50% cut lines 82 and 80 serve to retain the two separate trays 16 together. The arrangement is desirable where the plurality of food portions 12 are such that the heating times for both are the same. It is within the contemplation of the present invention to provide a unitary food package which can be separated so that the contents 12 in each tray 16 can be separately handled and heated for different times when desirable.

Figure 11:
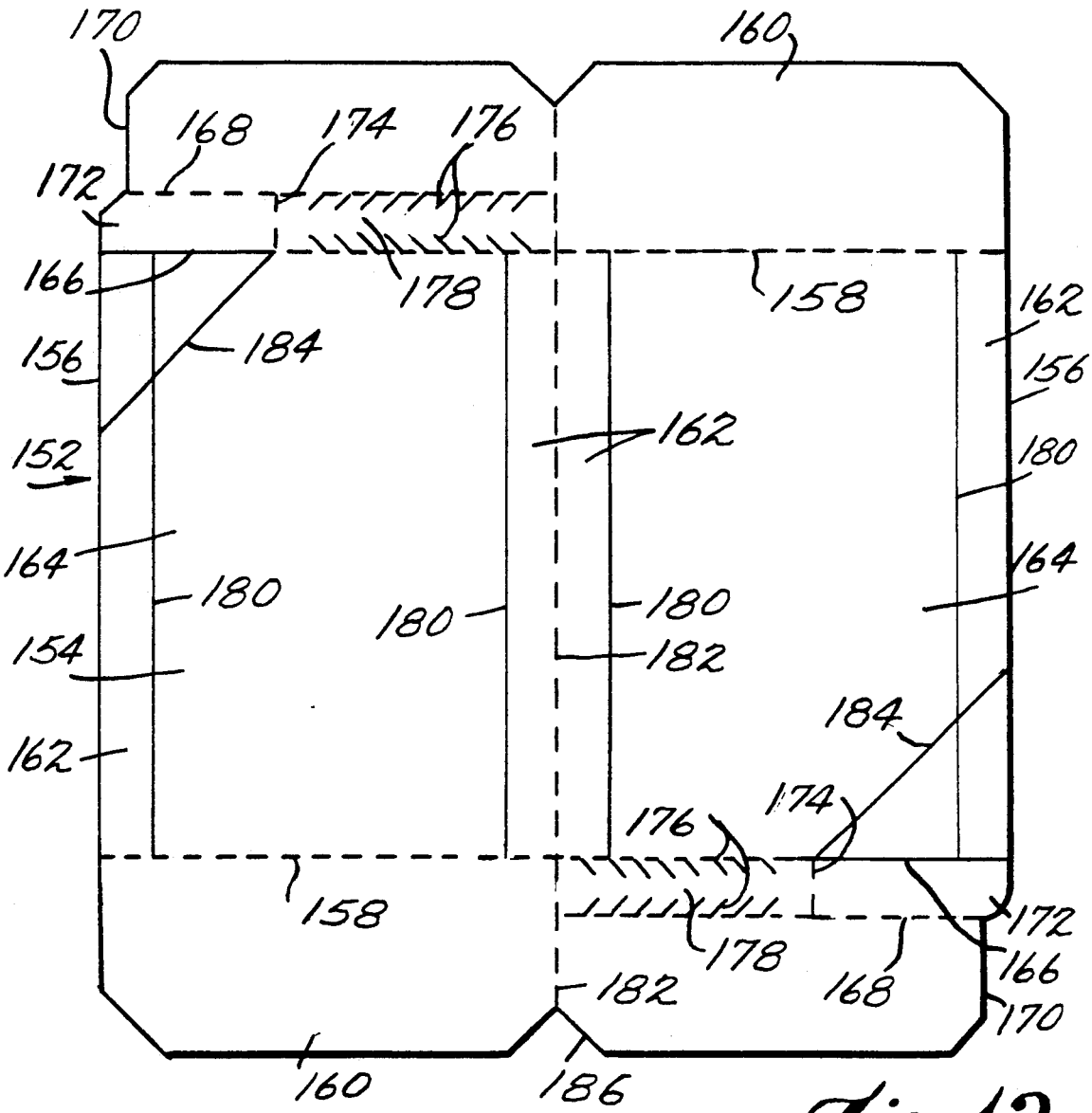
FIG. 11 is a view similar to FIG. 10 of a lid structure of modified form.
Figure 12:
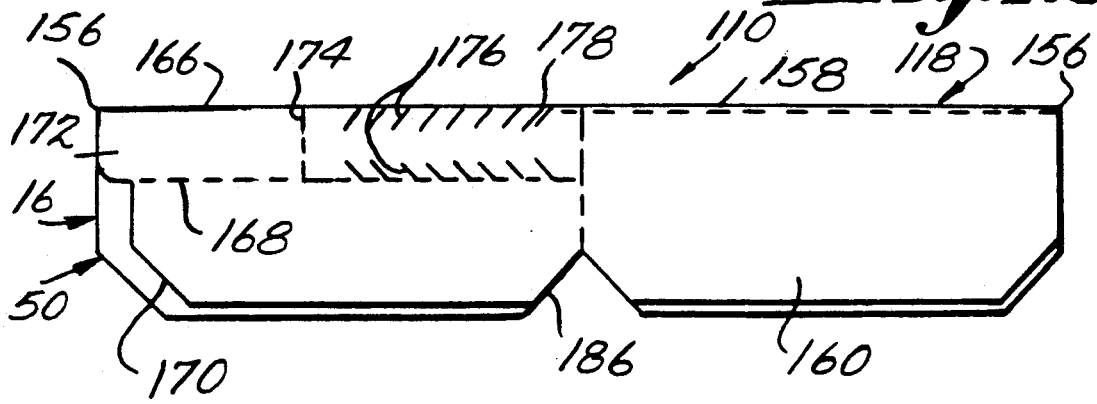
FIG. 12 is a side elevational view of a food package embodying the lid structure shown in FIG. 11.
Figure 13:
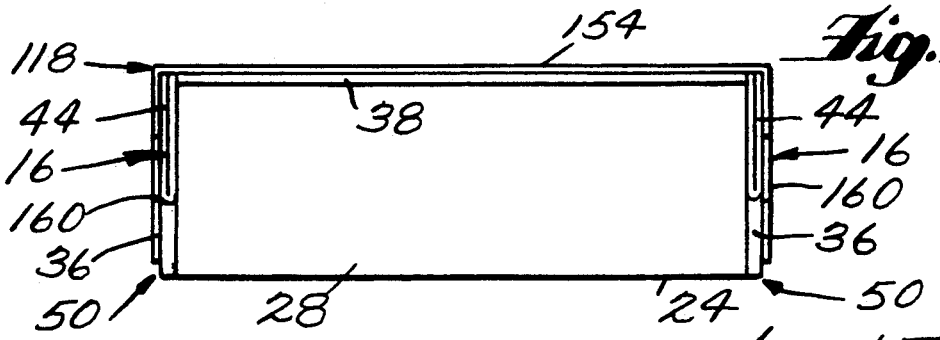
FIG. 13 is an end view of the package shown in FIG. 12.
Figure 15:
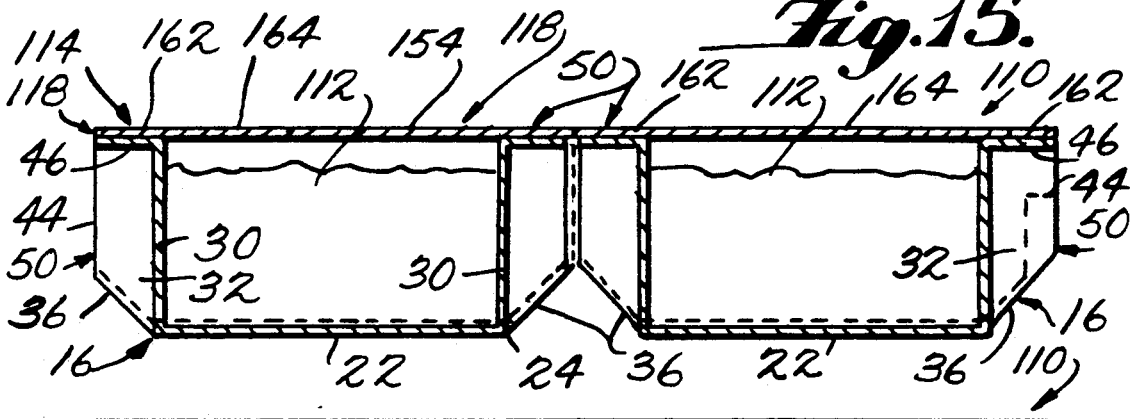
FIG. 15 is a sectional view taken along the lines 15—15 of FIG. 14.
Figure 14:
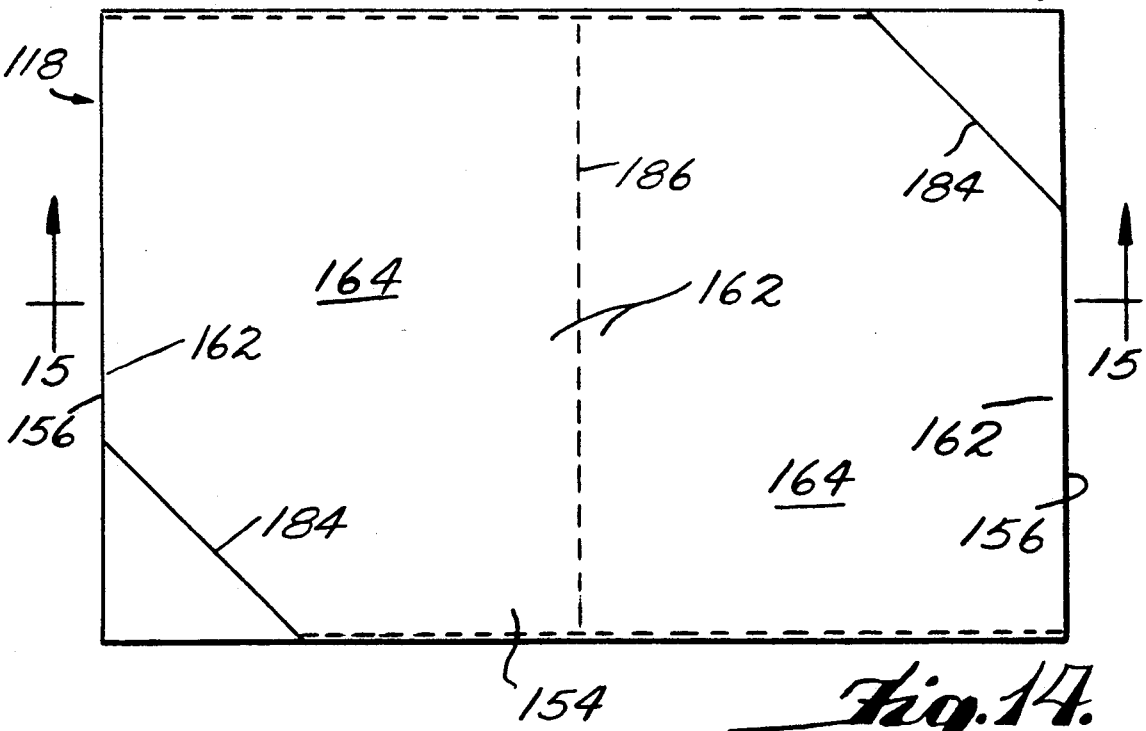
FIG. 14 is a top plan view of the package.

Referring now more particularly to FIGS. 11–15, there is shown therein a separable unitary food package 110 embodying the principles of the present invention. The package 110 includes two tray structures 16 containing food portions 12 and a lid structure 118 which serves to retain the food portions 12 within the trays 16. As best shown in FIG. 11, the lid structure 118 is formed from a carton lid blank 152 formed of carton material like that of the tray blank 20. The carton material is cut and scored to define a top wall panel 154 having a rectangular periphery defined on a first pair of opposite sides by cut lid sides or edges 156 and on a second pair of opposite sides by lid fold lines 158 extending between the cut edges 156. Formed integral with the top wall panel 54 along the lid fold lines 158 is a pair of lid flaps 160.

The top wall panel 154 includes a planar interior surface shown in FIG. 11 (the plastic film surface when a laminate is used as the carton material) which is divided into four flange-engaging strip-like portions 162, arranged so as to define two top panel portions 164 therein. As shown, two of the four flange-engaging portions 162 are disposed singly along the two cut edges 156 respectively and two are paired together and extend across the central area of the top wall panel 154 between fold lines 158. In the embodiment shown, the trays 16 are of the same capacity and size so that the paired central flange-engaging portions 162 are on center.

As before, when the package 110 is assembled, it will be understood that, after each tray blank 20 is erected into an open top tray structure 16, each tray is separately filled with a suitable food portion 12, such as shown in FIG. 8. Thereafter, a pair of filled trays 16 are oriented together in side-by-side relation with adjacent outwardly extending flanges 38 in generally closely spaced or abutting relation. Thereafter, the lid structure 118 is mounted over the paired trays 16 so that the downwardly facing interior surfaces of the flange-engaging portions 162 engage the upwardly facing surfaces of the flanges 38.

Where a plastic film laminate is used as the carton material, the interengaging surfaces of the flanges 38 and flange-engaging portions 162 will be plastic film surfaces which serve as adhesives when heated, as by a blast of hot air, to adhere the lid structure 118 to both of the tray structures 16. Thereafter, top flaps 160 are folded downwardly along lid fold lines 158 so as to bring the interior surfaces of the top flaps 160 into abutting relation with the exterior surfaces of the side walls 30 of the trays 16. Suitable adhesives are applied between the lower portions of these abutting surfaces to complete the assembly of the package 110.

As assembled, it will be noted that the top panel portions 64 serve to close the open top of the two trays 16 and enclose the food portions 12 separately in each tray 16. The adhesively adhered and interengaged relation between the flange-engaging portions 162 and lower portions of the top flaps 160 with the portions of the trays represented by the flanges 38 and lower portions of side walls 30 retain the assembly in a unitary package suitable for transportation and handling.

FIG. 11 illustrates one embodiment of the preferred cuts provided to facilitate the manual opening of the package 110. In the embodiment shown, each of the top flaps 160 has its fold line 158 configured so that an end portion extending into a different one of the top panel portions 64 is a conventional bar score 66. Formed in the end portion of each top flap 160 in parallel relation to the bar score 166 is a broken line of perforate cuts 168. An outer end section of each top flap 160 aligned with the associated single flange-engaging portion 162 beyond the perforate cuts 168 is cut out as indicated at 170, so as to expose a corner section of each top flap 160 between the perforated cuts 168 and the bar score 166. Each corner section forms a part of a lifting tab 172 defined at one end by the exposed corner section and at an opposite end by transversely extending broken line of perforate cuts 74.

The remainder of the associated half of each top flap 160 inwardly of each lifting tab 172 is provided with a series of perforate angular cuts 176 defining a zip strip 78. It will be noted that aligned portions of the angular cuts 176 define a portion of the associated fold line 158. The other half of each fold line 158 may be of any suitable construction, such as a bar score or the broken line of perforate cuts as shown.

In order to facilitate the lifting of the top panel portions 164 into opening relation, there is formed in the interior surface of the top wall panel 154 a series of parallel 50% cut lines 180. The cut lines 180 are disposed in positions to define the inner edges of the single flange-engaging portions 162 and the outer edges of the paired flange-engaging portions 162. As shown, a central broken line of perforate cuts 82 is formed in the top wall panel 54 so as to be disposed between the two interior cut lines 180 associated with the paired central flange-engaging portions 162. As before, a diagonal fold line 184 extends from each lifting tab end 174 to the associated exterior cut edge 156. Fold lines 84 are preferably bar scores. Finally, it will be noted that the broken line of perforate cuts 182 formed in the top wall panel 154 extends at both ends into the top flaps 160 to a central notch 186 formed in the central outer portion of each top flap 160.

Where the fold line 158 of the other top flap 160 is provided by a broken line of perforate cuts, each top panel portion can be removed from the remainder of the package 110. When the fold line 158 is a bar score, the top panel portions are simply folded back. It can thus be seen that substantially full access to the heated contents 12 of each of the trays 16 can be readily obtained by the user.

The package 110 is similar to the package 10 except that the broken line of perforate cut 182 which extends between the two central notches 186 and each top flap 160 enables the user to separate the package into two separable units simply by applying a separating pressure to the notches sufficient to cause the perforate cut to release the lid structure 18 into two separate pieces, each of which is still in closed relation with an associated tray 16. This capability enables the user to heat the contents of each tray for a separate or different time period.

Otherwise, it will be noted that the package 110 is assembled in the same way as the package 10, is of unitary construction for convenient transportation and handling in the same way as the package 10, and is capable of being opened in substantially the same way as the package 10 with respect to each of the trays thereof.

In all of the embodiments of the invention specifically described above and shown in the drawings, it will be noted that the carton assembly 14 provides rigidity to the package 10 or 110. This rigidity is provided by the side-by-side flanges 38 of the trays 16 extending across the central portion of the top wall panel 54 or 154 between the top flaps 60 or 160 and the downward extension of the top flaps from the top wall panel which form exterior sides of the package. While it is preferable to adhesively adhere the top flaps 60 or 160 in surface-to-surface engagement with side wall panels 30 of the trays 16, in the broader aspects of the invention the securement could be accomplished by providing bottom flaps extending inwardly from the lower edges of the top flaps 60 or 160 and adhesively adhering the bottom flaps to the bottom wall panels 22 of the trays 16. An example of such an arrangement is shown in the '599 application. Moreover, the associated flanges need not be folded inwardly but could either be eliminated or folded outwardly and then adhesively adhered to the top flaps and folded downwardly therewith.

Likewise, the side wall panels 28 of the trays 16 which extend along the cut edges 56 and 156 of the top wall panel 54 and 154 are preferably adhesively adhered to the corresponding outwardly extending flanges 38 or 138. In the broader aspects of the invention, the securement could be made between the flanges 38 or 138 and additional top flaps with the additional top flaps and adhered flanges 38 or 138 being folded downwardly from the top wall panel 54 or 154 and adhesively adhered either to the adjacent tray side panels 28 or by additional bottom flaps on the additional top flaps adhesively secured to the bottom wall panels 22. Moreover, where such additional top flaps are utilized to effect the securement as aforesaid, the associated flanges 38 or 138 may either extend inwardly or be eliminated altogether.

The differences in the positioning of the cuts which facilitate opening within the lid blank of the two embodiments illustrate variations which are possible. Thus, there is no particular criticality in the location of the cuts insofar as the broad aspects of the present invention is concerned. That is, the lifting tab associated with each tray may be on any one of the four corners of the tray with the zip strip extending alongside the lifting tab. Moreover, it should be understood that, in the broadest aspects of the present invention, other cut arrangements for opening packages of this type can be utilized such as, for example, the arrangements in the aforesaid '451 and '832 patents.

It will be seen that the objects of this invention have been fully and effectively accomplished. It will be realized that the foregoing preferred specific embodiment has been shown and described for the purpose of this invention and is subject to change without departure from such principles. This invention includes all modifications encompassed within the spirit and scope of the following claims.

What is claimed is:

1. A food package comprising:

a plurality of separate portions of food and a carton assembly, said carton assembly comprising a plurality of separate open top trays corresponding in number to the number of separate portions of food and a lid structure, each of said open top trays being formed from a blank of carton material cut and scored to form a bottom wall panel having a periphery defined by interconnecting side fold lines having side wall panels extending therefrom which are interconnected by gusset wall portions, the side wall panels having outer edges at least one of which is defined by a flange fold line having a flange extending therefrom, each of said tray-forming blanks being folded and secured in an open top tray-forming condition wherein (1) said side wall panels are folded along said side fold lines to form tray sides around a tray bottom formed by said bottom wall panel, (2) said gusset wall portions are folded and sealed to provide liquid-tight corners for said tray sides, and (3) said flange is folded along said flange fold line to form an outwardly extending flange along the one outer edge of said side wall panels, said lid structure being formed from a flat blank of carton material cut and scored to form a top wall panel having a periphery defined along two sides by top flap fold lines and two top flaps integral along said top flap fold lines with said top wall panel, the separate relation of said open top trays enabling each of said separate portions of food to be separately disposed within a corresponding separate open top tray, the separate relation of said lid structure enabling said lid structure and trays after the separate portions of food have been disposed in the trays to be moved relatively together into an assembled relation forming said carton assembly wherein (1) the top wall panel extends over the trays with the flanges of the trays extending in side-by-side relation in surface-to-surface engagement with a central portion of the top wall panel between said top flaps and (2) the top flaps are folded downwardly from said top wall panel along the top flap fold lines thereof so as to form exterior sides of the carton assembly, said lid structure and trays being fixedly secured by adhesive into said assembled relation including an adhesive between said flanges and said top wall panel adhering the same in surface-to-surface engagement, said carton assembly having cuts formed therein for facilitating the manual movement of at least a section of said top wall panel extending over the open top of each tray into an open position with respect to the open top of each tray enabling the portion of food in each tray to be heated in an oven and thereafter consumed while in the respective tray.

2. A food package as defined in claim 1 wherein said top wall panel includes perforated broken line cuts extending thereacross between opposite top flap fold lines in a position between each pair of adjacent flange-engaging portions thereof, and said top flaps have perforated broken line cuts extending thereacross from the top flap fold lines thereof in alignment with associated perforated broken line cuts in said top wall panel, said perforated broken line cuts enabling said lid structure to be manually separated so that each tray can be handled separately with a separated part of said lid structure in assembled relation therewith.

3. A food package as defined in claim 1 wherein the side fold lines defining the periphery of each bottom wall panel comprise four side fold lines interrelated so that there are four pairs of different adjacent side fold lines wherein each pair of adjacent side fold lines extend at an angle with respect to each other from a corner point defining one of four corners of said bottom wall panel, the side wall panels of each open top tray comprising four side wall panels integral with said bottom wall panel along said four side fold lines interrelated so that there are four different pairs of adjacent side wall panels, each gusset wall portion of each tray comprising a gusset wall panel integral with each pair of adjacent side wall panels along two end fold lines extending in angularly related relation with respect to one another from the corner point associated with the pair of adjacent side fold lines with which said pair of adjacent side wall panels is integral, said four side wall panels of each tray being folded along said four side fold lines in a direction which is the same relative to said bottom wall panel into an erected position while each of said gusset wall panels is folded along the associated angularly related end fold lines in opposite directions with respect to the associated pair of adjacent side wall panels so as to bring each gusset wall panel into surface-to-surface abutting relation with an end portion of one of the associated pair of adjacent side wall panels defined by one of the associated two end fold lines, and an adhesive adhering each of said gusset wall panels of each tray in surface-to-surface abutting relation with the associated one side wall end portion to thereby form a sealed integral corner construction between each pair of adjacent side wall panels which is defined (1) exteriorly by the associated gusset wall panel adhesively adhered in abutting relation to the associated one side wall end portion with the associated one end fold line extending generally in a plane coincident with an interior surface of the associated one side wall panel from the associated corner point and (2) interiorly by another of the associated two end fold lines extending from the associated corner point generally along the interior surface of the associated one side wall panel.

4. A food package as defined in claim 3 wherein said four side wall panels of each tray include first and second pairs of opposed side wall panels, said side wall end portions of each tray being provided at opposite ends of said second pair of said opposed side wall panels so that said integral sealed corner constructions extend outwardly from opposite ends of said first pair of opposed side wall panels, said first pair of opposed side wall panels having a pair of outer edges, one of which is said one outer edge, said pair of outer edges being defined by a pair of flange fold lines, one of which is the flange integral with the flange fold line on said one outer edge.

5. A food package as defined in claim 4 wherein said second pair of opposed side wall panels of each tray have edge wall panels integral therewith along edge fold lines generally parallel with the side fold lines thereof, said edge wall panels being folded along said edge fold lines inwardly so as to extend in generally parallel relation with said bottom wall panel.

6. A food package as defined in claim 4 wherein the periphery of said top wall panel includes two parallel sides extending between ends of said top flap fold lines, said top wall panel having an interior surface within said periphery engaged along spaced areas by the pair of flanges of each tray, the spaced surface areas engaging the pair of flanges of each tray being disposed within spaced flange-engaging portions defining therebetween a top panel portion in said top wall panel enclosing the open top of the associated tray, said flange-engaging portions being arranged singularly at said two parallel sides of said top wall panel.

7. A food package as defined in claim 6 wherein of said top flaps are folded along said top flap fold lines in overlapping relation with the second pair of opposed side wall panels of each of said trays, said top flaps having interior surface areas engaged with exterior surface areas of said second pair of opposed side wall panels of each of said trays and adhered thereto by said adhesive.

8. A food package as defined in claim 7 wherein said manual movement facilitating cuts include (1) cuts associated with each top panel portion thereof extending partially therethrough along cut lines extending from spaced positions at one top flap fold line associated with each top panel portion substantially to an opposite fold line associated with each top panel portion so as to define therebetween a section of each top panel portion which can be separated to provide access to the associated tray through the open top thereof, and (2) tab defining cuts in the one top flap associated with each top panel portion defining a lifting tab at a corner of the associated top panel portion suitable to be gripped and manually lifted to separate the associated section by delamination along the cut lines.

9. A food package as defined in claim 8 wherein the corner of each top panel portion at which the associated lifting tab is defined has a diagonal fold line extending from the one top flap fold line associated with the top panel portion to one of the associated cut lines enabling an initial manual lifting of the lifting tab to fold the corner back along the diagonal fold line to vent the associated tray during heating in an oven preparatory to the consumption of the heated portion of food therein through access provided by the separation of the associated section as aforesaid.

10. A food package as defined in claim 9 wherein said manual movement facilitating cuts include zip strip defining cuts associated with each tab defined by said tab defining cuts defining a strip suitable to be gripped at one end and then manually separated from the associated top flap to thereby free the associated top panel portion along the remainder of the side thereof defined by the associated top flap fold line, the one end of said strip being disposed adjacent the associated lifting tab so as to become convenient to grip only after said lifting tab has been lifted initially to fold back the associated corner.

11. A food package as defined in claim 10 wherein the top wall panel is defined along said two other opposed sides by cut edges, said cut lines including an edge cut line extending in marginal parallel relation to each cut edge along an associated flange-engaging portion so that during the separation of the associated section the flange-engaging portion of the top wall panel between the associated edge cut line and cut edge delaminates.

12. A food package as defined in claim 11 wherein the cut lines include a pair of parallel cut lines extending along a pair of adjacent flange-engaging portions, the cut lines defining said pair of parallel cut lines extending partially through said top wall panel from the interior surface thereof so that during the separation of the associated sections the pair of adjacent flange-engaging portions delaminates.

13. A food package as defined in claim 12 wherein said top wall panel includes perforated broken line cuts extending thereacross between opposite top flap fold lines in a position between each pair of adjacent flange-engaging portions thereof, said top flaps have perforated broken line cuts extending from the top flap fold lines thereof in alignment with associated perforated broken line cuts in said top wall panel to marginal notches therein, said perforated broken line cuts enabling said lid structure to be manually separated so that each tray can be handled separately with a separated part of said lid structure in assembled relation therewith.

14. A food package as defined in claim 7 wherein said top wall panel includes perforated broken line cuts extending thereacross between opposite top flap fold lines in a position between each pair of adjacent flange-engaging portions thereof, and said top flaps have perforated broken line cuts extending thereacross from the top flap fold lines thereof in alignment with associated perforated broken line cuts in said top wall panel, said perforated broken line cuts enabling said lid structure to be manually separated so that each tray can be handled separately with a separated part of said lid structure in assembled relation therewith.

15. A food package as defined in claim 13 wherein said top flaps have marginal notches therein leading to the broken line cuts therein.

16. A plurality of erectable carton blanks capable of being secured together to form a carton assembly of a unitary package containing a plurality of separate food portions, said plurality of carton blanks comprising a plurality of separate tray-forming blanks of carton material each being cut and scored to form a bottom wall panel having a periphery defined along four sides by four side fold lines interrelated so that there are four pairs of different adjacent side fold lines wherein each pair of adjacent side fold lines extend at an angle with respect to each other from a corner point defining one of four corners of said bottom wall panel, four side wall panels integral with said bottom wall panel along said four side fold lines interrelated so that there are four different pairs of adjacent side wall panels and a gusset wall panel integral with each pair of adjacent side wall panels along two end fold lines extending in angularly related relation with respect to one another from the corner point associated with the pair of adjacent side fold lines with which said pair of adjacent side wall panels is integral, one of said side walls having a flange integral therewith along a flange fold line parallel with the side fold line thereof, said tray-forming blanks being foldable and sealable into a plurality of separate open top trays wherein (1) the side wall panels of each tray-forming blank are foldable along the side fold lines thereof to form tray sides (2) the gusset wall panels of each tray forming blank are foldable along the associated angularly related end fold lines in opposite directions with respect to the associated pair of adjacent side wall panels so as to bring each gusset wall panel into surface-to-surface abutting adhesively adhered relation with an end portion of one of the associated pair of adjacent side wall panels defined by one of the associated two end fold lines, and (3) the flange is foldable outwardly along said flanges fold line, a lid blank providing a lid structure, said lid blank being formed of carton material cut and scored to provide a top wall panel having a periphery defined along two sides by two top flap fold lines and two top flaps integral with said top wall panel along said top flap fold lines, said top wall panel having pairs of spaced flange-engaging portions defining a top panel portion therebetween, each pair of flange-engaging portions and the top panel portion therebetween being sized so that the pair of flange-engaging portions are capable of being disposed in engagement with the flanges of a tray erected from a tray-forming blank with the top panel portion enclosing the open top of the tray, said top flap being foldable downwardly other portions of said top wall panel along said top flap fold lines and being adapted to be secured to the erected trays at portions below the flanges thereof to complete the enclosure of the erected trays and form exterior sides of a unitary package suitable for transport and handling, said lid blank having cuts formed therein for facilitating the manual lifting of at least a section of each top panel portion into opening relation to each erected tray.

17. A plurality of erectable carton blanks as defined in claim 16 wherein said four side wall panels of each tray-forming blank includes first and second pairs of opposed side wall panels, said first pair of opposed side wall panels including said one side wall panel, said side wall end portions of each tray-forming blank being provided at opposite ends of said second pair of said opposed side wall panels so that, when erected as aforesaid, said integral sealed corner constructions extend outwardly from opposite ends of said first pair of opposed side wall panels, said flanges being foldable along said flange fold lines between the associated outwardly extending corner constructions.

18. A plurality of erectable carton blanks as defined in claim 17 wherein said second pair of opposed side wall panels of each tray-forming blank have edge wall panels integral therewith along edge fold lines generally parallel with the side fold lines thereof, said edge wall panels being foldable along said edge fold lines inwardly so as to extend in generally parallel relation with said bottom wall panel.

19. A plurality of erectable carton blanks as defined in claim 18 wherein the flange integral with said one side wall is one of a pair of flanges integral with said first pair of opposed side wall panels of each tray, said top wall panel having single flange-engaging portions arranged singularly at two other sides thereof extending between the ends of said top flap fold lines.

20. A plurality of erectable carton blanks as defined in claim 19 wherein said top flaps are foldable along said top flap fold lines in overlapping relation with the second pair of opposed side wall panels of each tray erected from said plurality of tray-forming blanks, said top flaps having interior surface areas engageable and adhesively adherable with exterior surface areas of said second pair of opposed side wall panels of each tray erected from said plurality of tray-forming blanks.

21. A plurality of erectable carton blanks as defined in claim 20 wherein the cuts in said lid blank includes (1) cuts associated with each top panel portion thereof extending partially therethrough along cut lines extending from spaced positions at one top flap fold line associated with each top panel portion substantially to an opposite fold line associated with each top panel portion so as to define therebetween a section of each top panel portion which can be separated to provide access to the associated erected tray through the open top thereof, and (2) tab defining cuts in the one top flap associated with each top panel portion defining a lifting tab at a corner of the associated top panel portion suitable to be gripped and manually lifted to separate the associated section by delamination along the cut lines.

22. A plurality of erectable carton blanks as defined in claim 21 wherein the corner of each top panel portion at which the associated lifting tab is defined has a diagonal fold line extending from the one top flap fold line associated with the top panel portion to one of the associated cut lines enabling an initial manual lifting of the lifting tab to fold the corner back along the diagonal fold line to vent the associated tray during heating in an oven preparatory to the consumption of the heated portion of food therein through access provided by the separation of the associated section as aforesaid.

23. A plurality of erectable carton blanks as defined in claim 22 wherein the cuts in said lid blank include zip strip defining cuts in a top flap associated with each lifting tab defined by said tab-defining cuts defining a strip suitable to be gripped at one end and then manually separated from the associated top flap to thereby free the associated top panel portion along the remainder of the side thereof defined by the associated top flap fold line, the one end of said strip being disposed adjacent said lifting tab so as to become convenient to grip only after said lifting tab has been lifted initially to fold back the associated corner.

24. A plurality of erectable carton blanks as defined in claim 23 wherein the top wall panel is defined along said two other sides by cut edges, said cut lines including an edge cut line extending in marginal parallel relation to each cut edge along an associated single flange-engaging portion so that during the separation of the associated section the associated single flange-engaging portion of the top wall panel between the associated edge cut line and cut edge delaminates.

25. A plurality of erectable carton blanks as defined in claim 24 wherein the cut lines include a pair of parallel cut lines extending along said pair of adjacent flange-engaging portions, the cuts defining said pair of parallel cut lines extending partially through said top wall panel from the interior surface thereof so that during the separation of the associated sections the pair of adjacent flange-engaging portions delaminates.

26. A plurality of erectable carton blanks as defined in claim 25 wherein said top wall panel includes perforated broken line cuts extending thereacross between opposite top flap fold lines in a position between each pair of adjacent flange-engaging portions thereof, and said top flaps have perforated broken line cuts extending thereacross from the top flap fold lines thereof in alignment with associated perforated broken line cuts in said top wall panel, said perforated broken line cuts enabling said lid structure to be manually separated so that each erected tray can be handled separately with a separated part of said lid structure and in assembled relation therewith.

27. A plurality of erectable carton blanks as defined in claim 16 wherein said top wall panel includes perforated broken line cuts extending thereacross between opposite top flap fold lines in a position between each pair of adjacent flange-engaging portions thereof, and said top flaps have perforated broken line cuts extending thereacross from the top flap fold lines thereof in alignment with associated perforated broken line cuts in said top wall panel, said perforated broken line cuts enabling said lid structure to be manually separated so that each erected tray can be handled separately with a separated part of said lid structure in assembled relation therewith.

28. A plurality of erectable carton blanks as defined in claim 27 wherein said top flaps have marginal notches therein leading to the broken line cuts therein.

29. A plurality of erectable carton blanks capable of being secured together to form a carton assembly of a unitary package containing a plurality of separate food portions, said plurality of carton blanks comprising a plurality of separate tray-forming blanks of carton material each being cut and scored to form a bottom wall panel having a periphery defined by interconnecting side fold lines having side wall panels extending therefrom which are interconnected by gusset wall portions, the side wall panels having outer edges at least one of which is defined by a flange fold line having a flange extending therefrom, said tray-forming blanks being foldable and sealable into a plurality of separate open top trays wherein (1) the side wall panels of each blank are foldable along the side fold lines thereof to form tray sides around a tray bottom formed by the bottom wall panel thereof, (2) the gusset wall portions of each blank are foldable and sealable to provide liquid tight corners for the tray sides of each tray, and (3) the flange of each blank is foldable along the flange fold line to form an outwardly extending flange along the upper edge of one tray side, and a lid blank providing a lid structure, said lid blank being formed of carton material cut and scored to provide a top wall panel having a periphery defined on two sides by two top flap fold lines and two top flap integral with said top wall panel along said top flap fold lines, said top wall panel having a pair of side-by-side flange-engaging portions in the central portion thereof between said top flap fold lines defining top panel portions on opposite sides thereof, said pair of flange-engaging portions and said top panel portions being sized so that the pair of flange-engaging portions are capable of being disposed in engagement with side-by-side flanges of side-by-side trays erected from said tray-forming blanks with the top panel portions enclosing the open tops of the trays, said top flaps being foldable downwardly from said top wall panel along said top flap fold lines and being adapted to be secured to the erected trays at positions below the flanges thereof to complete the enclosure of the erected trays and form exterior sides of a unitary package suitable for transport and handling, said lid blank having cuts formed therein for facilitating the manual lifting of at least a section of each top panel portion into opening relation to each erected tray.

30. A plurality of erectable carton blanks as defined in claim 29 wherein said top wall panel includes perforated broken line cuts extending thereacross between opposite top flap fold lines in a position between each pair of adjacent flange-engaging portions thereof, and said top flaps have perforated broken line cuts extending thereacross from the top flap fold lines thereof in alignment with associated perforated broken line cuts in said top wall panel, said perforated cuts enabling said lid structure to be manually separated so that each erected tray can be handled separately with a separated part of said lid structure in assembled relation therewith.

31. A plurality of erectable carton blanks as defined in claim 30 wherein said top flaps have marginal notches therein leading to the broken line cuts therein.

* * * * *